United States Patent [19]

Hussein

[11] 4,223,857

[45] Sep. 23, 1980

[54] SWITCHING ARRANGEMENT FOR MODEL TRAINS

[76] Inventor: Said S. Hussein, 2814 Kennedy Blvd., Jersey City, N.J. 07306

[21] Appl. No.: 42,019

[22] Filed: May 24, 1979

[51] Int. Cl.[2] ..... B61L 11/08

[52] U.S. Cl. ..... 246/231; 246/249; 246/270 A; 246/415 A

[58] Field of Search ..... 246/270 A, 270 R, 231, 246/202, 219, 221, 225–228, 415 A, 415 R, 242 C, 247, 249, 265; 104/88, 147 A, 149; 40/251, 216

[56] References Cited

U.S. PATENT DOCUMENTS

| | | | |
|---|---|---|---|
| 1,382,691 | 6/1921 | Theofilos | 246/231 |
| 1,891,059 | 12/1932 | Rosenthal | 246/231 |
| 1,919,272 | 7/1933 | Caruso | 246/231 |
| 3,030,499 | 4/1962 | Pagenhardt | 246/231 |
| 3,126,179 | 3/1964 | Bonanno | 246/231 |
| 4,077,591 | 3/1978 | Ray | 246/415 A |

*Primary Examiner*—Edward R. Kazenske

*Assistant Examiner*—Reinhard J. Eisenzopf

*Attorney, Agent, or Firm*—Brumbaugh, Graves, Donohue & Raymond

[57] ABSTRACT

A switching arrangement for model trains includes tracks arranged in multiple closed paths which have at least one track section in common. The various paths are interconnected by remote controlled track switches. In order to assure that the train traverses the tracks in a random fashion, a signaling device activated by the passage of the train, is located in the common track section. The speed of the train, and hence its residence time over the signaling device, determines the length of the signal produced by this device. This signal drives a motor for its duration, which motor moves a selection arm that passes contacts wired to the tracks switches. The location of the track switching contacts are randomly spaced over the path of the selection arm. Since the train may move at various speeds and the contacts are randomly spaced, the positions of the track switches that are operated by each passage of the train over the common section of track are randomly selected.

10 Claims, 7 Drawing Figures

SWITCHING ARRANGEMENT FOR MODEL TRAINS

BACKGROUND OF THE INVENTION

This invention relates to switching arrangements for model trains and, more particularly, to automatic switching arrangements that operate based on the position of the train.

Large scale model railroad layouts usually have a number of interconnected track paths. In order to move the train from one of these paths to another, track switches are provided. Since it would be inconvenient to have to set each of these track switches by hand at the location of the switch in order to vary the path of the train, remote controlled switches operated from a common point have been provided. Typically, these track switches are electromagnetically operated, such as the switches in U.S. Pat. No. 1,919,272 to Caruso or U.S. Pat. No. 3,126,179 to Bonanno.

With complicated switching arrangements it is possible for the operator to set a particular track switch in the wrong position so that the model train is derailed at the switch. In order to avoid this, some switches, such as those in the above-mentioned patent to Bonanno, are provided with contact arms which are moved when the wheels of the train pass over them. If the track switch is in the wrong position as the train approaches it, the operation of the contact arms causes it to move to the correct position.

In U.S. Pat. No. 3,030,499 to Pagenhardt there is disclosed an automatic switching device for model railroads. One of the cars of the model train is equipped with a magnet which can be positioned so that one or the other of its poles is facing the tracks. Located on the tracks at a location prior to an electromagnetic track switch is a pivotable magnet which can move into contact with one or the other of two conductor strips. As the train moves over the pivot magnet, the field from its magnet forces one end or the other of the pivotal magnet onto one or the other of the strips, depending on which pole of the train magnet is facing the tracks. Contact of the pivotal magnet on one of the strips creates a signal that causes the track switch to move to a selected position. However, it can be seen that only one switch is operated by this device and, depending on the position of the train magnet, the track is always switched in the same direction. If the magnet on the train is rotated so that its other pole faces the track, the switch will always be set to the other position.

Watching model trains can become boring if they always move in the same predictable path. Therefore, it would be advantageous, particularly for model train displays, if the path of the train could be switched automatically and in a random fashion.

SUMMARY OF THE INVENTION

The present invention is directed to providing apparatus for automatically and randomly switching the path of model trains. This object is achieved by switching the trains by means of track switches controlled from randomly spaced contacts on a selection device and by incrementally moving an arm of the selection device, so as to create a new switch arrangement, by an amount dependent on the speed of the train.

In an illustrative embodiment of the invention the tracks of the model train layout are arranged in multiple closed paths which, by means of remote controlled track switches, are connected together so that they have at least one section of track in common. Located in this common track section is a signaling device that is actuated by the passage of the model train and produces an output signal proportional to the time it takes the train to pass. Thus, the duration of the output signal is also proportional to the speed of the train over the signaling device. A motor, with a track selection arm connected to its shaft, is operated so as to rotate the arm for the duration of the output signal of the signaling device. Contacts on a plate over which the arm moves are connected to the remote controlled track switches. There are at least two contacts supplied for each switch so that the switch can be moved between its two positions by a signal applied over the arm.

Since the contacts for the switches are at random locations along the path of the movable arm, and the distance the arm moves is variable, depending on the speed of the train, it is clear that each time the train passes over the common track section, a new and randomly selected track switch arrangements will automatically be set up. This selection does not depend on any other train being present and it works continuously without the need to be reset.

BRIEF DESCRIPTION OF THE DRAWINGS

The foregoing and other features of the present invention will be more readily apparent from the following detailed description and drawings of illustrative embodiments of the invention in which.

DESCRIPTION OF PREFERRED EMBODIMENTS

Figure 1:
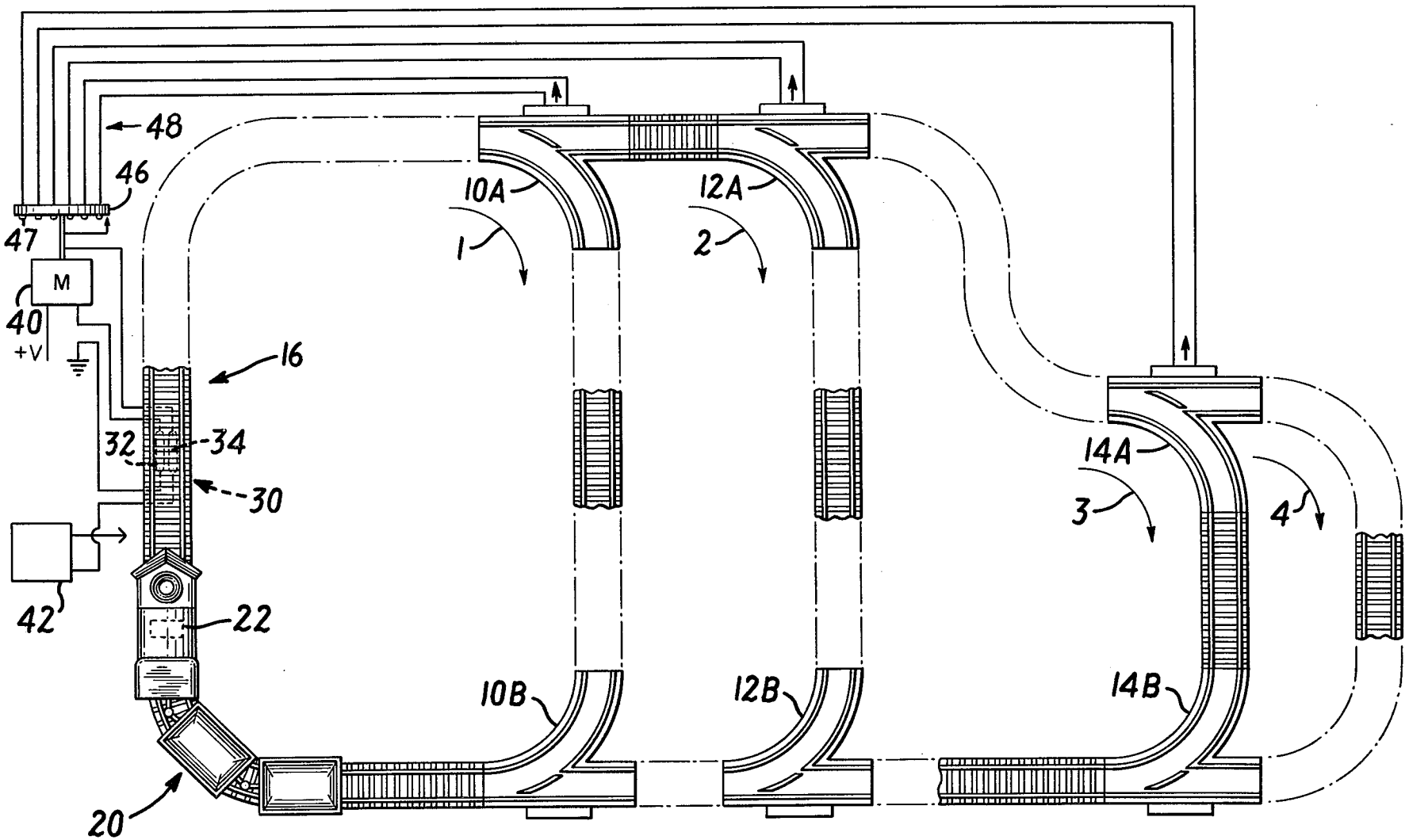
FIGS. 1 is an illustrative embodiment of a model railroad layout according to the present invention.

In FIG. 1 there is shown a model railroad track layout that has four paths indicated by arrows 1–4. Each of these paths is interconnected by remotely operated track switches 10, 12 and 14, which may be electromagnetic track switches such as those manufactured by Tyco as model 910-1. The interconnection of these track paths is such that there is a section 16 of the track that is common to each path. A model train 20, which travels over the track paths in a manner determined by the track switches, is shown traversing the common track section 16 in FIG. 1.

Along the tracks in section 16 is a signaling device 30 in the form of two normally open magnetic reed switches 32, 34. A magnet 22 shown in dotted line in FIG. 1 and located on the bottom of one of the cars of the train, actuates the reed switches for as long as the magnet is in proximity to the switches. Thus, it can be seen that the period of time for which the switches are closed depends on the speed of the train over track section 16. For the period of time that switch 32 is closed, a circuit is completed so that a voltage V is applied across a motor 40. In order to derive this voltage for the motor 40, which may be a 1.5 volt permanent magnet motor, the low voltage from a typical model train power pack 42, which is also used to drive the train and to power the track switches, may be divided down, rectified and filtered, if necessary. Alternatively, a separate source, e.g. a D size battery, may be provided.

Figure 3:
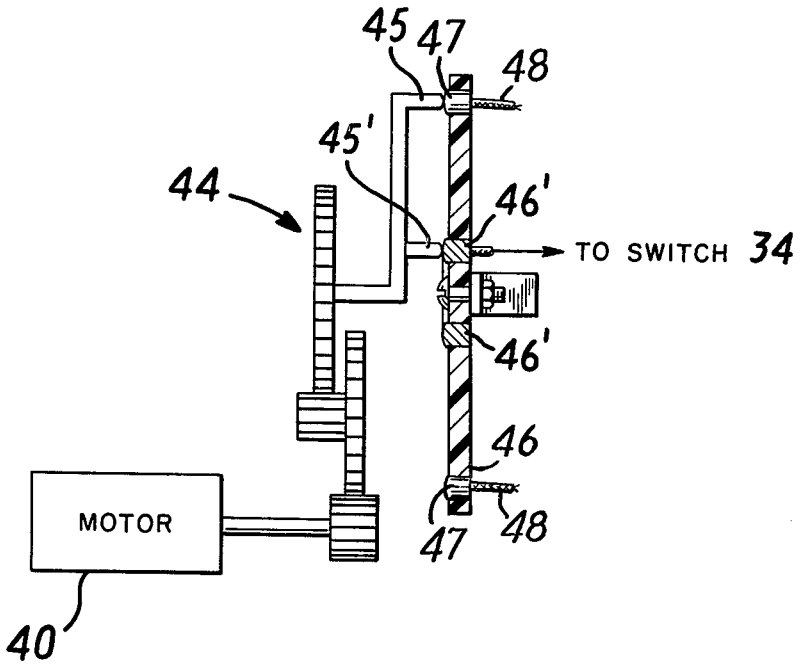
FIG. 3 is an enlarged side view of the motor and selection device of FIG. 1.

Connected to the motor 40 by means of a gearing 44 shown in FIG. 3, is a wiper arm 45. The motor typically runs at 3400 rpm and the gears reduce the speed of the wiper to 90 rpm. This wiper arm is a conductor and is connected to the ground side of power pack 42 via a suitable wiper branch 45', a conducting ring 46' contacted by the branch, and the reed switch 34. Because of this arrangement, the motor, and hence the arm 45, moves only for the period that the magnet 22 is in proximity to the reed switches. Also, there is a ground on this arm only for that same period.

Figure 4:
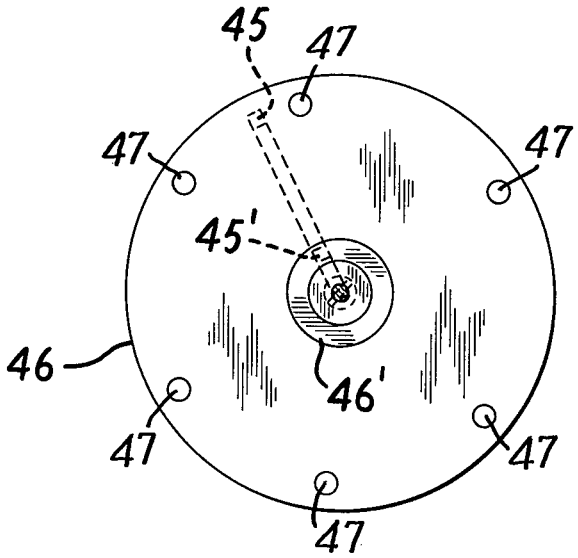
FIG. 4 is a front view of the contact arrangement of the selection device of FIG. 3.

A plate 46 supports the conducting ring 46' and a number of contacts 47 spaced about the circular path of the wiper arm (FIG. 4). Each contact, which can be grounded by the wiper arm, is connected via leads 48 to one or more of the track switches. The track switches have a central common terminal COM (FIG. 5) which is supplied with voltage from power pack 42, and left (L) and right (R) terminals. If a ground is momentarily applied to the left or right terminal, the track switch will move to the corresponding position and remain there even if the ground is removed. In FIG. 1 the left and right terminals of switches 10A, 12A and 14A are all connected by the leads 48 to the contacts on plate 46. As the arm moves under the influence of motor 40, a ground is applied to the left and right switch terminals causing them to assume new positions. This will occur once for each passage of the train 20 over the signaling reed switches 30.

In order to assure that the path of the train has at least a pseudo-random appearance, the contacts are spaced at varying distances from each other along the path of the arm 45, as shown in FIG. 4. Consequently, even if the train moves at the same speed, causing the wiper to move the same distance each time, the effect of this movement will be different. Also, if the speed of the train changes, the movement of the arm will be less for greater speeds and more for slower speeds, thereby adding an additional randomizing factor. The operation of the circuit can be made even more random by connecting the left and right terminals of particular switches to more than one contact, especially when a great a number of contacts are provided on plate 46. If the section 16 of track is hidden by a terrain feature, such as a model mountain with tunnels, then even the respective passing of the train over that common track section will be disguised. Also, the switch selection apparatus can be hidden in this way.

Figure 2B:
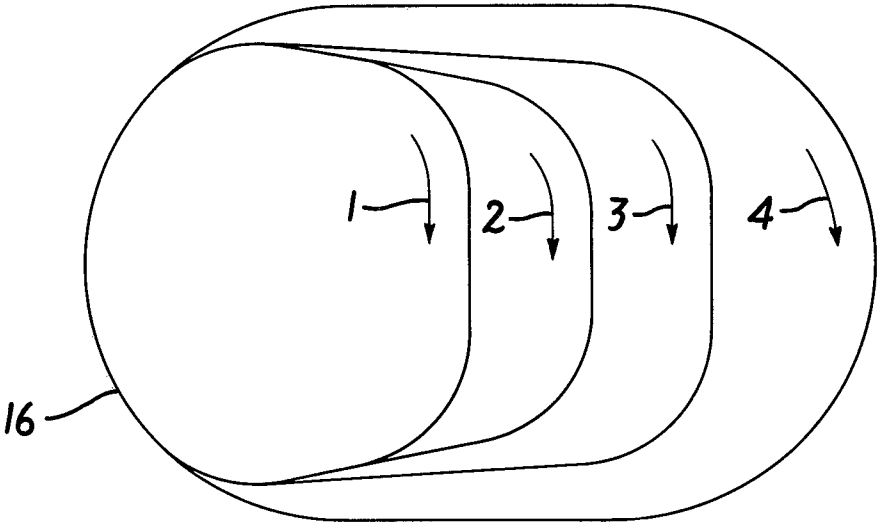
FIGS. 2A, 2B and 2C are alternative track layouts.
Figure 2A:
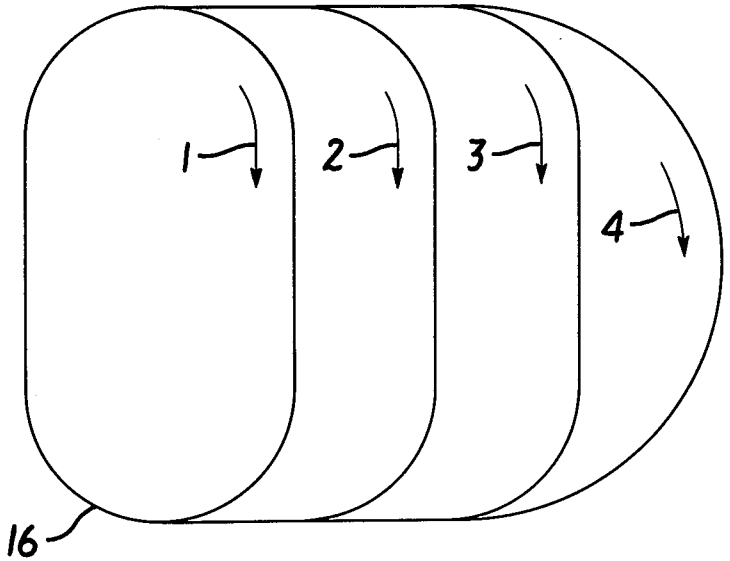
Figure 2C:
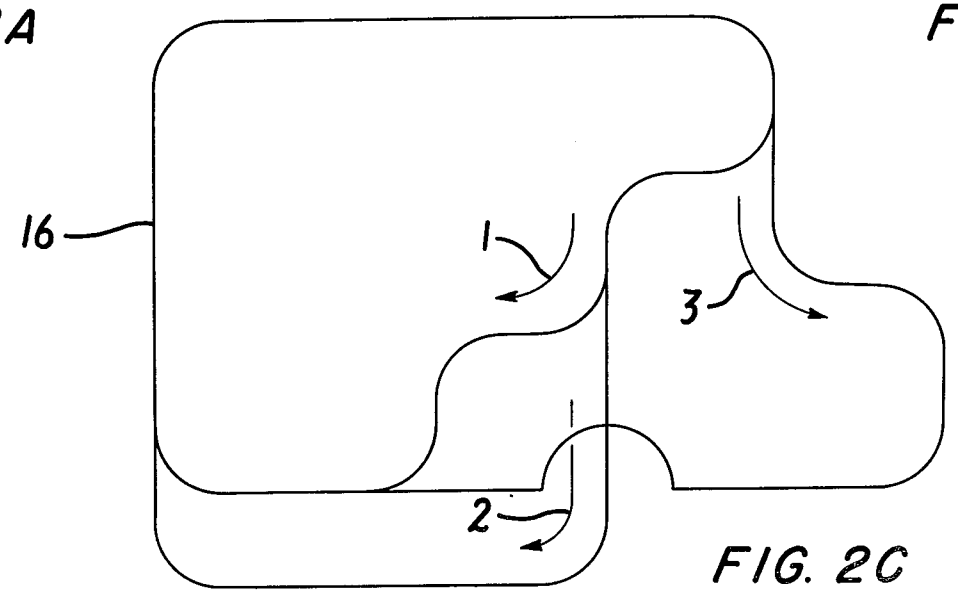

FIG. 2A shows a track layout which is essentially the same as that in FIG. 1, but the paths have been made circular for simplicity. Fig. 2B, however, illustrates an alternative arrangement, but one in which the multiple closed paths still have a common track section 16. Naturally, the path of the tracks within any closed path need not be circular, as is shown in FIG. 2C. Any arrangement of closed paths is acceptable, so long as there is one track section common to all. If there were not such common track section it would be possible for the train to get onto a closed path that did not take it over the signaling device, thus eliminating the ability to provide automatic random switching. Nevertheless, it is possible to arrange a track layout in which there are paths that do not go over a common track section, provided those paths have another track section in common and a further signalling device is located in that other section.

It should be noted in FIG. 1 that only the switches 10A, 12A and 14A are shown connected to the contacts and not switches 10B, 12B and 14B. The wiring to these "B" switches is not shown because it must compliment that of the "A" switches or the train will derail at the "B" switches. As an alternative the "B" switches need not be wired to the contacts on plate 46 if they are provided with contact arms, such as those shown in U.S. Pat. No. 3,126,179 to Bonanno, or are manual switches designed so that the wheels of the train can force them to the position in which the train would not be derailed.

Figure 5:
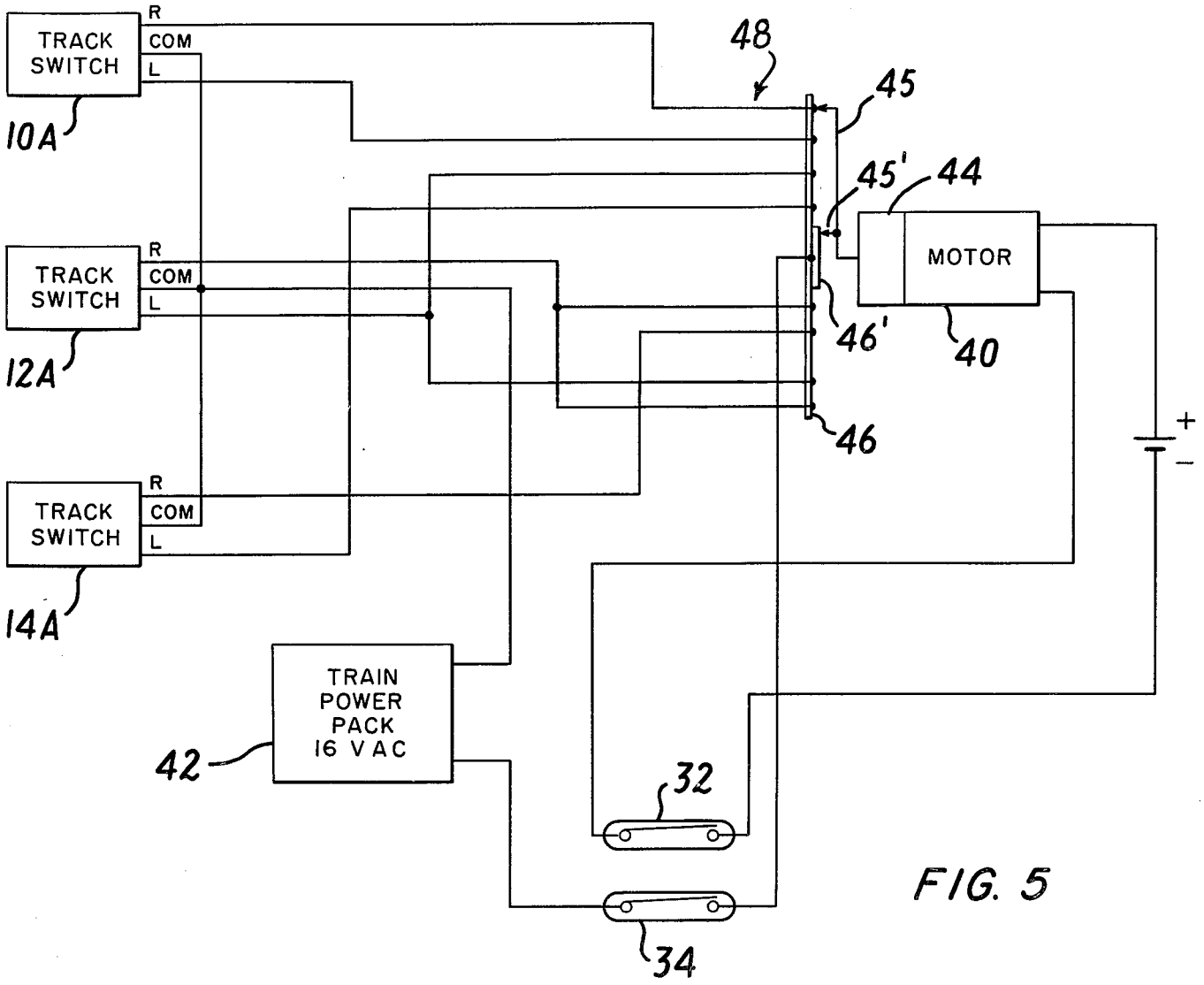
FIG. 5 is a typical wiring diagram for the layout of FIG. 1.

In FIG. 5 there is shown a wiring diagram in which the voltage terminal of the train power pack 42 is shown connected to the common terminals of switches 10A, 12A and 14A. The ground side of the power pack is connected through reed switch 34 to conducting ring 46', also shown in FIGS. 3 and 4. The purpose of switch 34 is to make sure that only a momentary ground is applied to the track switches so they are not burned out by excessive current if the wiper arm should happen to stop directly on a contact. Of course if the track switch can handle the current or if it has built-in power cut-off for burn out protection, reed switch 34 can be eliminated. By means of the wiper 45' which runs on ring 46', the ground potential of the power pack is supplied to the wiper, which in turn applies it to either the left and right terminals of the track switches. The motor that moves the arm is shown in FIG. 5 to be operated from a voltage source over magnetic reed switch 32. As the arm rotates it actuates the track switch terminals connected to the contacts as it passes over them. Assuming that the contacts shown in FIG. 5 are located in order along one half of the path of the arm, the following sequence of track changes would occur:

TABLE

| Step | Switch | Direction |
|---|---|---|
| 1 | 10A | right |
| 2 | 10A | left |
| 3 | 12A | left |
| 4 | 14A | left |
| 5 | 12A | right |
| 6 | 14A | right |
| 7 | 12A | left |
| 8 | 12A | right |

It is possible, if the train is going fast enough, that the arm will not move far enough to cause any track change. Also, it may move enough to cause several changes. For example, it could cause the changes from step 1 to 3 to occur, which would leave switch 10A in the same position, i.e. left, but would also change switch 14A. It should be noted that switch 10A is switched left during the sequence and stays that way for the remaining steps. This allows the train to get out of path 1 so that it can reach the other switches. Thus, it is important that the wiper cause every switch it passes to change. If it did not, there would be only a one in six chance that switch 10A would be in the left position so as to allow the train to pass to the other paths. With the present arrangement it is assured that whenever step 2 is passed switch 10A will be properly set.

While the present invention has been particularly shown and described with reference to preferred embodiments thereof, it will be understood by those skilled in the art that various changes in form and details may be made therein without departing from the spirit and scope of the invention.

I claim:

1. An automatic track switching arrangement for model railroads comprising:

a set of tracks arranged in multiple closed paths which have at least one track section in common;

remote controlled track switches being provided at the intersections of the multiple closed paths;

a signaling device located, at least in part, along the common track section and being actuated by passage of at least one car of a model railroad train, said device being actuated for a period related to the time at least a portion of the car is in proximity to said signaling device;

a motor operated by said signaling device; and a selection means moved by said motor for switching selected ones of said track switches based on the position of said selection means as determined by said motor.

2. An automatic track switching arrangement as claimed in claim 1 wherein said track switches are electromagnetically operated between at least two positions by applying a certain potential to at least one of a plurality of terminals of said switch.

3. An automatic track switching arrangement as claimed in claim 2 wherein said track switches are operated by momentarily applying a ground signal to said switches.

4. An automatic track switching arrangement as claimed in claim 2 wherein said signaling device comprises:

a first magnetic reed switch located along the common track section, one end of said first switch being connected to a certain potential and the other being connected to said motor means; and a magnet attached to one of the cars of said trains in such a position as to actuate the reed switch for as long as it is in proximity to said reed switch.

5. An automatic track switching arrangement as claimed in claims 2 or 4, wherein said selection means comprises:

a conducting wiper arm connected to a certain potential and driven along a path by said motor; and a plate supporting a plurality of contacts that are connected to the terminals of said track switches, said contacts being arranged along the path of said wiper arm.

6. An automatic track switching arrangement as claimed in claim 5 wherein the distance between said plurality of contacts along the path of said wiper arm is variable.

7. An automatic track switching arrangement as claimed in claim 5 wherein the connection of said contacts to said track switch terminals is in a random sequence.

8. An automatic track switching arrangement as claimed in claims 3 or 4, wherein said selection means comprises:

a conducting wiper arm driven along a path by said motor;

a plate supporting a plurality of contacts that are connected to the terminals of said track switches, said contacts being arranged along the path of said wiper arm; and an auxiliary signaling device that is located at least in part, along the common track section, said auxiliary device being actuated by the passage of the at least one car for a period related to the time at least a portion of that car is in proximity to said auxiliary signaling device, upon actuation said auxiliary signaling device applying a certain potential to said wiper arm.

9. An automatic track switching arrangement as claimed in claim 8 wherein said auxiliary signaling device comprises a second magnetic reed switch located along the common track section, one end of said second switch being connected to a certain potential and the other end connected to said wiper arm, said auxiliary signaling device being actuated by a magnet attached to one of the cars of said train.

10. An automatic track switching arrangement as claimed in claim 1 wherein the track switches of each multiple path at the positions where the multiple paths enter the common section of track and leave the common section of track are operated together to prevent derailment of the train.

* * * * *